US007749094B2

(12) United States Patent
Chen

(10) Patent No.: US 7,749,094 B2
(45) Date of Patent: Jul. 6, 2010

(54) GOLF CLUB GRIP AND MANUFACTURING METHOD THEREOF

(76) Inventor: Yung Hsiang Chen, 2416 Gehrig St., Unit B, West Covina, CA (US) 91792

( * ) Notice: Subject to any disclaimer, the term of this patent is extended or adjusted under 35 U.S.C. 154(b) by 345 days.

(21) Appl. No.: 11/982,097

(22) Filed: Oct. 31, 2007

(65) Prior Publication Data

US 2008/0125238 A1 May 29, 2008

Related U.S. Application Data

(63) Continuation-in-part of application No. 11/604,129, filed on Nov. 22, 2006, which is a continuation-in-part of application No. 11/192,775, filed on Jul. 29, 2005, now Pat. No. 7,160,202, and a continuation-in-part of application No. 10/771,710, filed on Feb. 3, 2004, now Pat. No. 7,008,582, which is a continuation-in-part of application No. 29/196,500, filed on Dec. 29, 2003, now Pat. No. Des. 502,750.

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS 1,890,037 A * 12/1932 Johnson ..... 473/300
5,322,290 A * 6/1994 Minami ..... 473/201
6,843,732 B1 * 1/2005 Huang ..... 473/300
2001/0041626 A1 * 11/2001 Madelle et al. ..... 473/295
2008/0312005 A1 * 12/2008 Hung ..... 473/300
2009/0075747 A1 * 3/2009 Kou ..... 473/300

FOREIGN PATENT DOCUMENTS

JP 2000-325514 * 11/2000

* cited by examiner

*Primary Examiner*—Stephen L. Blau
(74) *Attorney, Agent, or Firm*—Raymond Y. Chan; David and Raymond Patent Firm

(57) ABSTRACT

A golf club grip includes a first grip member and a second grip member. The first grip member has a dark color and a first material density. The second grip member which has a light color and a second material density which is greater than the first material density, wherein the first grip member is integrated with the second grip member in an edge-to-edge manner to form an elongated tubular structure. When the first grip member and the second grip member is heated to integrate with each other, particles of the second grip member crosses over the first grip member to form a predetermined amount of light color at the first grip member, while the light color formed at the first grip member is adapted to be overlaid by the dark color so as to render the light color and the dark color sharply distinguishable on the gold club grip.

11 Claims, 13 Drawing Sheets

GOLF CLUB GRIP AND MANUFACTURING METHOD THEREOF

CROSS REFERENCE OF RELATED APPLICATION

This is a Continuation-In-Part of a non-provisional application having an application number of Ser. No. 11/604,129 and a filing date of Nov. 22, 2006, which is a Continuation-In-Part of a non-provisional application having a application number of Ser. No. 11/192,775 and a filing date of Jul. 29, 2005 now U.S. Pat. No. 7,160,202, and is a Continuation-In-Part of a non-provisional application having an application number of Ser. No. 10/771,710, a filing date of Feb. 3, 2004, and a U.S. Pat. No. 7,008,582, which is a Continuation-In-Part of a non-provisional application having an application number of Ser. No. 29/196,500, a filing date of Dec. 29, 2003, and a patent number of D,502,750.

BACKGROUND OF THE PRESENT INVENTION

1. Field of Invention

The preset invention relates to a golf accessory, and more particularly to a golf club grip having at least two integrated portions with different natures to form a tapered tubular body for attaching to a holding end portion of a shaft of a golf club.

2. Description of Related Arts

Golf is one of the most popular sports in the world. All lower handicapped golfers recognize that the main key of having a good golf swing mostly depends on whether the golfer correctly grips the golf club.

No matter a golfer uses an interlocking grip, a natural grip or an overlapping grip, a proper grip is one of the most important fundamental. If the golfer grips his or her golf club too tight, his or her arms will be too tense to release the body twisting power to maximize the club head speed at impact of the golf ball through a golf swing. On the other hand, if the golfer grips his or her golf club too loose, the golf club may slip out of his or her hands through the golf swing. Also, the power from the uncoiling body will fail to transmit to the golf club through the golfer's hands. The flying trajectory, such as straight, draw or fade, of the golf ball can also be controlled by the gripping hands of the golfer.

The term "grip" is misleading since it implies a forceful pressure. In fact, a more proper way is to "mold" the golfer's hands into the proper position, and then to hold the golf club with the proper amount of pressure that allows the hands to work together to control the club head. For a right-hand golfer, his or her left hand will be the upper holding hand and his or here right hand will be the lower controlling hand. For a left-hand golfer, the right hand will be the upper holding hand and the left hand will be the lower controlling hand.

The middle finger H1, ring finger H2 and little finger H3 of the upper holding hand H, i.e. the left hand of a right-hand golfer, are used to hold on the upper end portion of the grip G of a golf club, as shown in FIG. 5. The three holding fingers H1, H2 and H3 should apply an appropriate pressure to the grip G that is enough to support and hold the golf club through the grip G. In other words, the golfer should be capable of holding the golf club at the upper end portion of the grip G without the other hand and the thumb and index finger contacting the grip G. By means of the three holding fingers H1, H2 and H3 with appropriate pressure applied to the grip, the arm of the golfer should become an extension of the golf club hinged to the golfer's body with his or her shoulder. The appropriate holding pressure of the three holding fingers H1, H2, H3 applied to the grip G varies with the weight and length of the golf club as well as the nature of the grip G. The minimum holding pressure should be just enough to hold the golf club to prevent slipping off the hand through the golf swing. Then, the index finger and the thumb of the upper holding hand H should be simply placed on the grip G in position as shown in FIG. 5.

Then, simply place the lower controlling hand H' on a middle portion of the grip G in such a manner that the ring finger H2', the middle finger H3' and the index finger H4' are placed on the grip G and aligned with the middle finger H3 of the upper holding hand H while the little finger H1' of the controlling hand H' is overlapped on top of the middle finger H3 of the holding hand H for an overlapping grip, or the little finger H1' of the controlling hand H' is interlocked with the middle finger H3 of the holding hand H for an interlocking grip. Also, the index finger and the thumb of the upper holding hand H should be simply placed on the grip in position as shown in FIG. 5 while the center of the palm of the controlling hand H' is facing the target. The grip pressure of the controlling hand H' is applied at the contacts of the middle phalanges H21', H31' of the ring finger H2' and the middle finger H3' of the controlling hand H' with the grip G.

In fact, by varying a few pressure points, you can better shape your shots. For example, in order to hit a fade, the golfer can grip the golf club a little bit tighter with the litter finger H1, the ring finger H2 and the middle finger H3 of the holding hand H. Also, when more pressure is exerted by the thumb and index finger of the controlling hand H' of the golfer, a right-to-left trajectory will be resulted.

In addition, the golfer can control the ball flying trajectory between a hook to a slice simply by adjusting the gripping position of the controlling hand H' with respect to the gripping position of the holding hand H, such as a strong grip or a weak grip. The grip pressure of the controlling hand H' is for feeling and controlling but not for supporting and holding the golf club. Therefore, the grip pressure of the controlling hand H' should be merely tight enough to control the club but still light enough to allow you to feel the weight of the golf club throughout the swing.

It is why most of the golfers wear gloves with their holding hands to enhance frictional contact with the grip but keeping their controlling hands bare to ensure feeling for swing control.

No matter whether the golfer grips the golf club somewhat firmly or softly, what is really important is keeping your level of grip pressure constant throughout the swing. Therefore, the nature and surface condition of the grip can substantially affect the golfer to apply the appropriate grip pressure. Some golf club grips provide anti-slip design on the grip surface for better frictional contact with the golfer's hands, it can substantially help to prevent slipping and provide constant grip pressure throughout the swing for the holding hand but may adversely affect the control and feeling of the controlling hand. Some golf club grips provide smooth and soft grip surface for better controlling but it also invites the holding hand to grip tighter to prevent slipping off. However, any excess grip pressure through the hand may also tense the arm and shoulder muscles and unexpectedly affect the golf swing. How to produce a grip that fits to the different needs of the holding hand and controlling hand of a golfer becomes a challenge for the development of a better club.

SUMMARY OF THE PRESENT INVENTION

A main object of the present invention is to provide a golf club grip which has at least two integrated portions with different natures to form a tapered tubular body for attaching to a holding end portion of a shaft of a golf club. Therefore, the golfer is able to tailor make the golf club grip depending on the personal preference and need by selecting the fabric textile, color, hardness and viscosity of each of the first and second members of the golf club grip.

Another object of the present invention is to provide a golf club grip, wherein the two portions of the golf grip are made of rubber in different colors for purposes of decoration and identification of the two portions for proper gripping with the holding and controlling hands of the golfer.

Another object of the present invention is to provide a golf club grip, wherein two portions of the golf grip are made of rubber in different hardness for purposes of identification of the two portions for proper gripping with the holding and controlling hands of the golfer.

Another object of the present invention is to provide a golf club grip, two portions of the golf grip are made of rubber with different compositions for purposes of identification of the two portions for proper gripping with the holding and controlling hands of the golfer.

Another object of the present invention is to provide a golf club grip, two portions of the golf grip are made of rubber with different viscosity for purposes of identification of the two portions for proper gripping with the holding and controlling hands of the golfer.

Another objective of the present invention is to provide a golf club grip which comprises a first portion forming an upper anti-slip arrangement and a second portion forming a lower control arrangement, wherein the upper anti-slip arrangement is connected coaxially with the lower control arrangement to form a tubular body for attaching to a holding end portion of a shaft of a golf club. The anti-slip arrangement provides a frictional surface to enable the three holding fingers (i.e. the middle, ring and little fingers) of a gloved holding hand of the golfer to better holding the golf club with appropriate pressure and the control arrangement provides a smoother surface to ensure better feeling and control for the bared controlling hand of the golfer.

Another objective of the present invention is to provide a golf club grip, wherein the anti-slip arrangement further comprises a cotton yarn reinforced surface layer to provide a coarse surface for better frictional contact with the gloved holding hand of the golfer and a harder surface structure than the control arrangement to ensure an anti-slipping grip with appropriate pressure while the control arrangement still provide a softer and smoother feel for controlling grip of the bared controlling hand of the golfer.

Another objective of the present invention is to provide a golf club grip, wherein the anti-slip arrangement of the grip has a length long enough for the three holding fingers (the middle, ring and little fingers) and the index finger of the upper holding hand of the golfer to completely grip thereon normally while the index finger is just placed at the lower end of the anti-slip arrangement, so that the ring, middle and index fingers of the controlling hand can naturally place on the control arrangement of the grip and align immediately with the index finger of the holding hand.

Another objective of the present invention is to provide a golf club grip, wherein the anti-slip arrangement at an upper portion of the grip and the control arrangement at a lower portion of the grip are made of rubber in different colors for purposes of decoration and identification of the two portions for proper gripping with the holding and controlling hands of the golfer.

Another objective of the present invention is to provide a golf club grip, wherein an upper portion of a bottom side of the control arrangement is provided with an anti-slip surface structure which is sized and shaped to ensure the middle phalanges of the ring, middle and index fingers of the lower controlling hand are in contact therewith to provide a better frictional contact for some golfers.

Another objective of the present invention is to provide a method for manufacturing the golf club grip with two integrated portions in economic cost, wherein the manufacturing process is easy and simple that the golfer is able to tailor make the golf club grip to fit the personal need in lower cost so as to ensure a comfortable interlocking, natural or overlapping grip between the holding hand and the controlling hand of the golfer.

Another objective of the present invention is to provide a method for manufacturing the golf club grip with anti-slip and control arrangement in economic cost, in which the cotton yarn surface reinforced anti-slip arrangement is integrated with the control arrangement to form an integral body with an even thickness at the junction between the lower end of the anti-slip arrangement and the upper end of the control arrangement so as to ensure a comfortable interlocking, natural or overlapping grip between the holding hand and the controlling hand of the golfer.

Accordingly, in order to accomplish the above objects, the present invention provides a golf club grip for a golf club including a shaft and a club head attached to a lower end of the shaft, wherein the golf club grip comprises:

at least a second member which is rubber made tube having a lower end, an upper end and a gripping-surface defining between the upper end and the lower end; and at least a first member which is rubber-made having an outer peripheral surface integrated with the second member to form an elongated integral tubular body for attaching to an upper end portion of the shaft of the golf club, wherein the first and second members have different natures to provide a corresponding number of different physical properties of the golf club grip.

These and other objectives, features, and advantages of the present invention will become apparent from the following detailed description, the accompanying drawings, and the appended claims.

DETAILED DESCRIPTION OF THE PREFERRED EMBODIMENT

Figure 1:
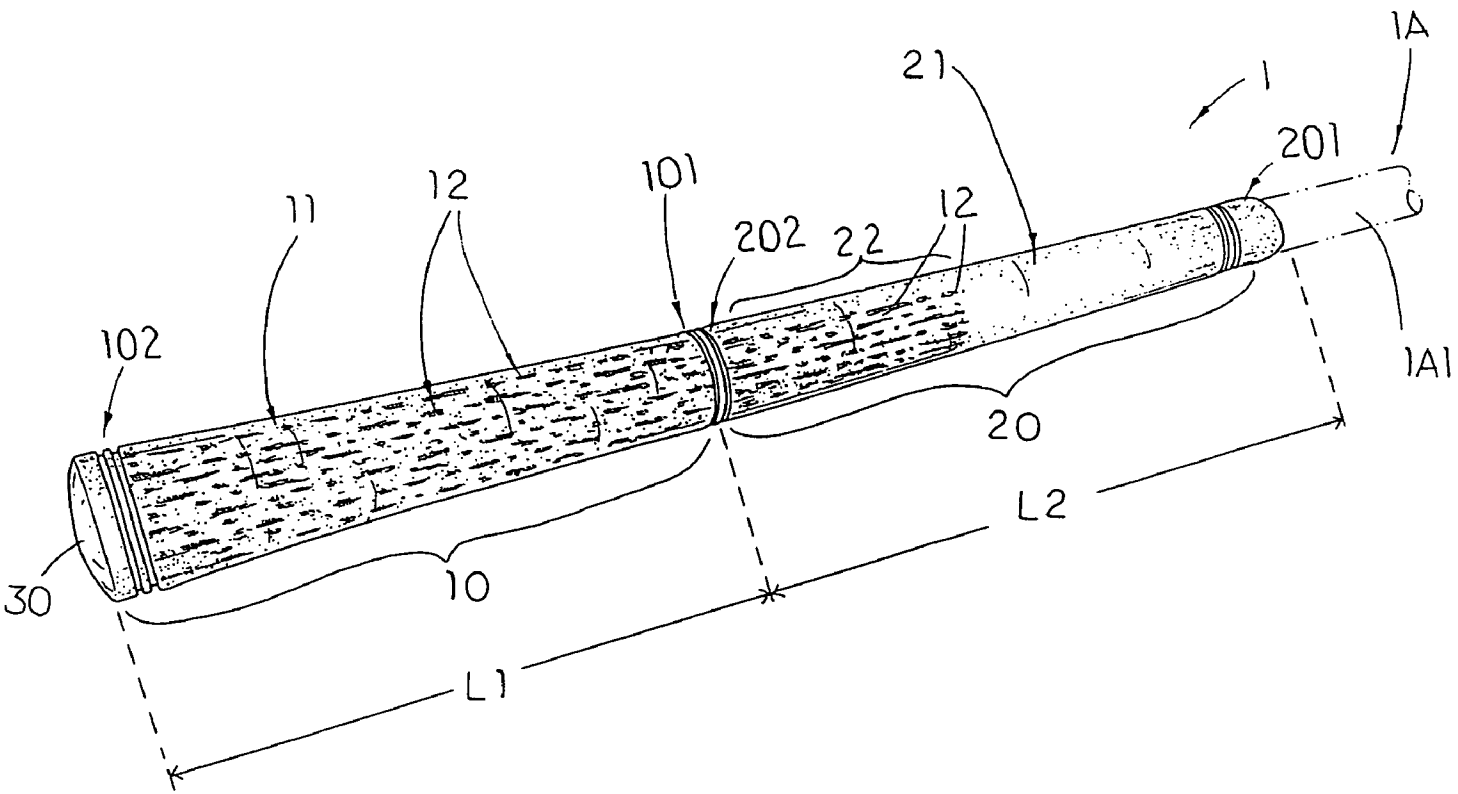
FIG. 1 is a perspective of a gold club grip according to a preferred embodiment of the present invention.

Referring to FIGS. 1 to 4 and 6 of the drawings, a golf club grip 1 for a golf club 1A according to a preferred embodiment of the present invention is illustrated, wherein the golf club grip 1 comprises a first member 20 and a second member 10.

The second member 20, which is rubber made tube, has a lower end 201, an upper end 202 and a gripping surface 21 defining between the upper end 202 and the lower end 201.

The first member 10, which is rubber made tube, has an upper end 102 and a lower end 101 coaxially integrated with the upper end 202 of the first member 20 to form an elongated integral tubular body for attaching to an upper end portion of the shaft of the golf club 1A, wherein the first member 10 has an outer circumferential surface 11 integrally extended from the gripping surface 21 of the second member 20. The first and second members 20, 10 have different natures to provide two different properties.

A shown in FIGS. 1 to 4, the first member 10 forms an anti-slip arrangement and the second member 20 forms a lower control arrangement to provide two different properties.

Accordingly, the circumferential gripping surface 21 of the second member 20 has a softness adapted for enhancing a sense of touching feel for a controlling hand H' of a golfer to grip thereon.

The anti-slip arrangement of the first member 10 is coaxially integrated with the upper end 202 of the second member 20 to form an elongated integral tubular body for attaching to the upper end portion of the shaft 1A of the golf club. The anti-slip arrangement of the first member 10 forms a circumferential anti-slipping surface on the circumferential surface 11 to provide a predetermined gripping friction for a holding hand H of the golfer to grip thereon.

The upper end 102 of the first member 10 of the golf club grip 1 further integrally provides a rubber made endpiece 30 to cover the upper end 102. The elongated integral tubular body of the golf club grip 1 is adapted for coaxially attaching to an upper end portion of a shaft 1A1 of the golf club 1A that can be a driver, a fairway wood, an iron, or a putter. The anti-slipping surface 11 of the second member 10 is constructed to provide a predetermined gripping friction for the holding hand H which generally wears a golf glove to grip thereon.

Figure 4:
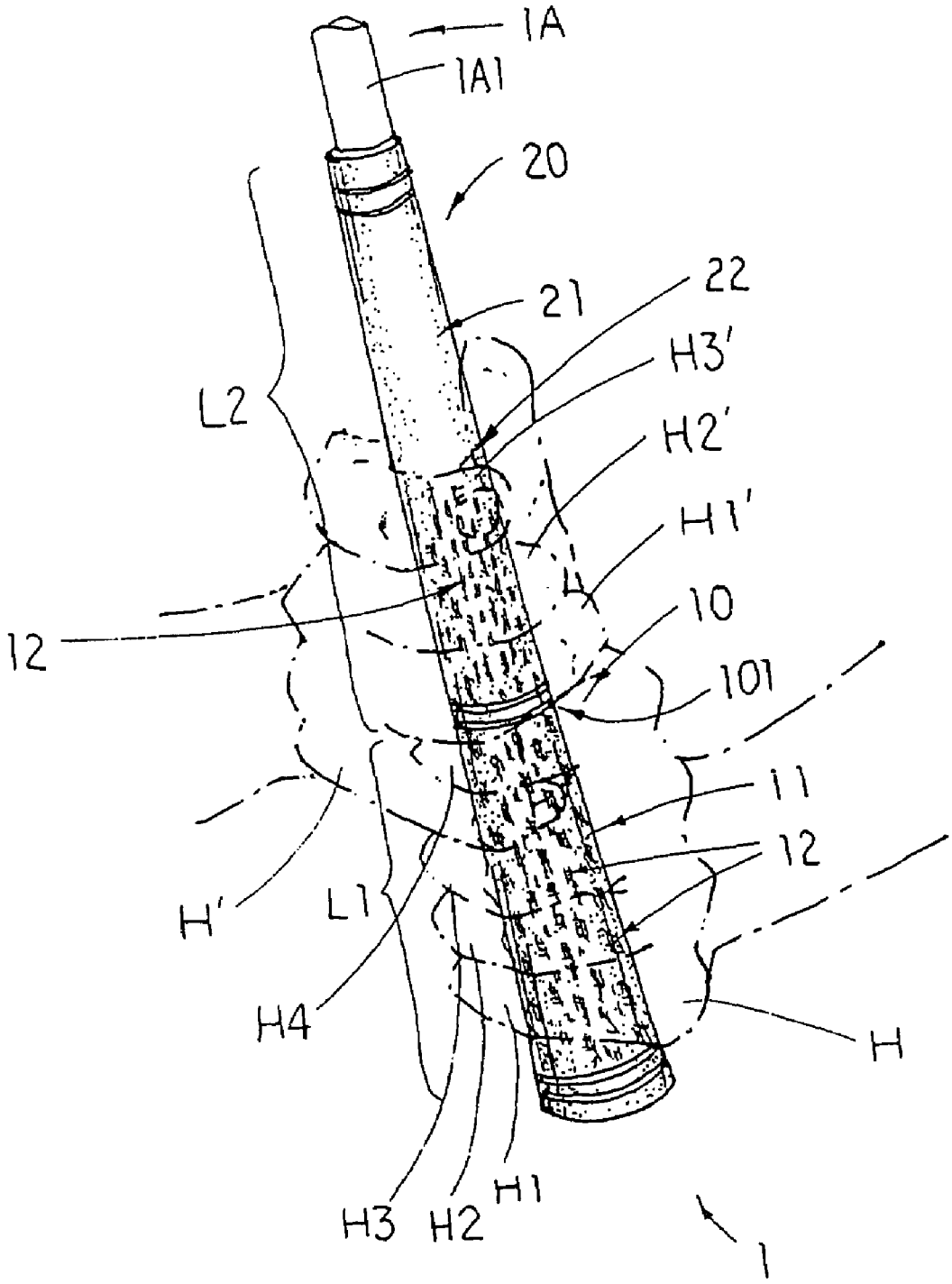
FIG. 4 is a schematic bottom view of the golf club grip attached to the golf club according to the above preferred embodiment of the present invention, illustrating the anti-slip arrangement gripped by a holding hand of a golfer and a control arrangement gripped by another controlling hand of the golfer.
Figure 5:
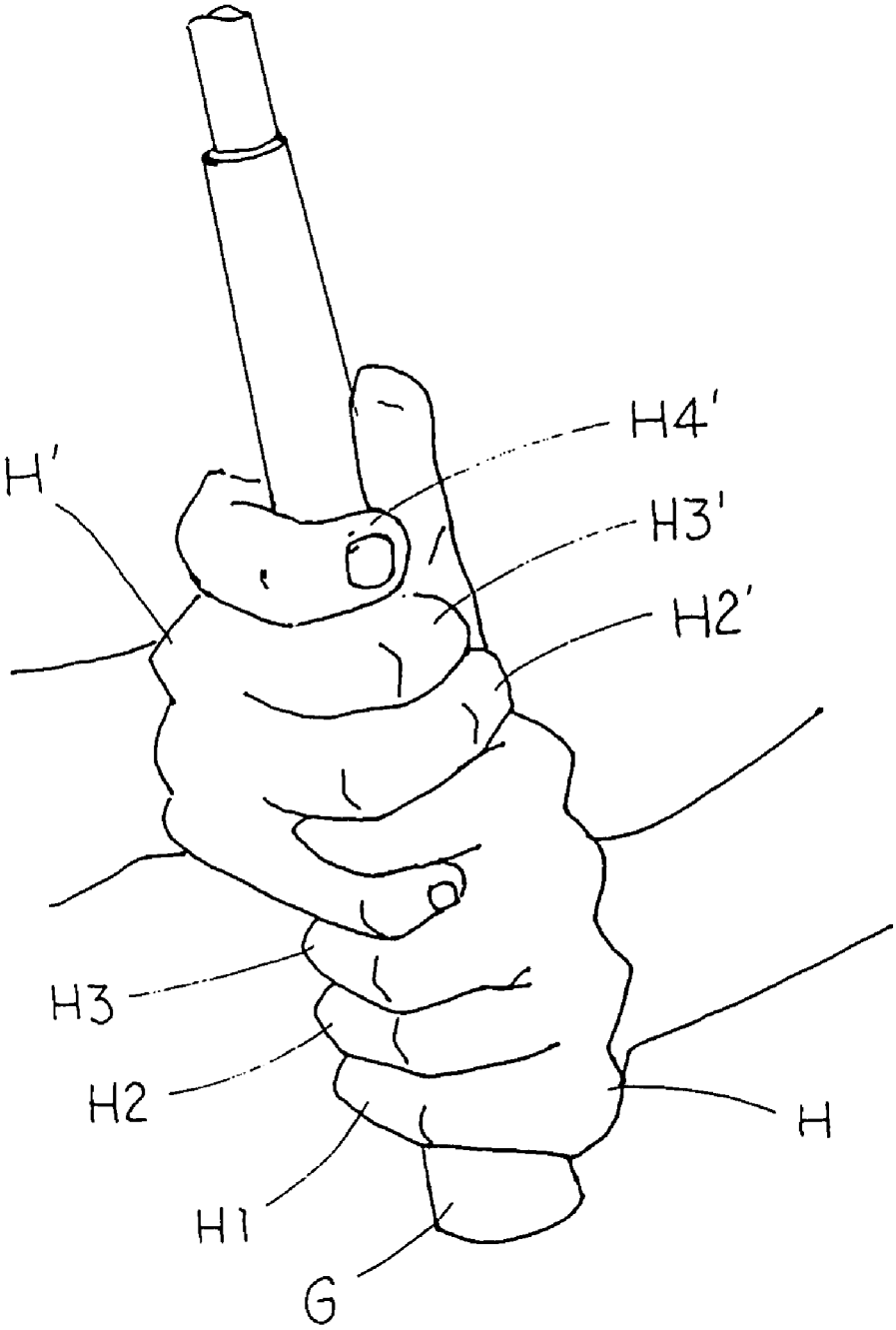
FIG. 5 PRIOR ART
FIG. 5 is a schematic view of a conventional golf club grip with a golfer gripped with both hands.

Referring to FIGS. 1 and 4, the anti-slip arrangement of the first member 10 has a predetermined length L1 long enough for at least a middle finger H3, a ring finger H2 and a little finger H1 of the holding hand H of the golfer to be completely gripped thereon and that a ring finger H2', a middle finger H3' and an index finger H4' of the controlling hand H' of the golfer is capable of naturally placing on the control arrangement 20.

Of course, the golf club grip 1 can be classified into man size, woman size, teenager size, and child size according to the different sizes of their hands. Therefore, the length L1 of the anti-slip arrangement of the first member 10 should be varied from different size of the holding hand of man, woman, teenager, or children of different age according to the requirement as described above.

Figure 3:
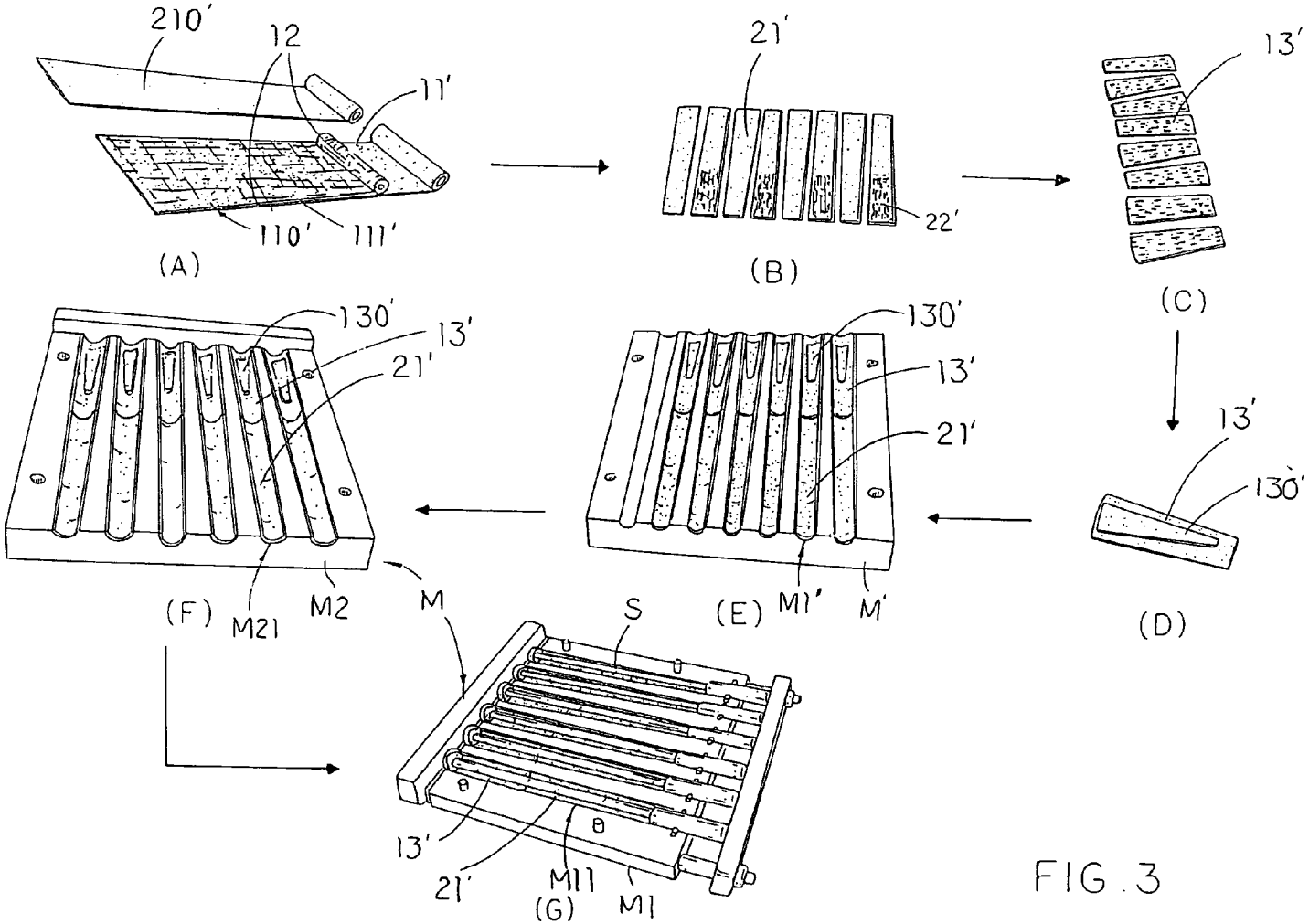
FIG. 3 illustrates a step of a method of manufacturing a golf club grip for the golf club according to the above preferred embodiment of the present invention.

In order to better understand the novel structure of the golf club grip 1 of the present invention to form the anti-slip arrangement of the first member 10 and the lower control arrangement of the second member 20, a method of manufacturing the golf club grip 1 according to the preferred embodiment of the present invention is illustrated in FIG. 3 and described in the following, wherein the method comprises the following steps.

(a) Overlap a textile fabric such as a cotton yarn 12 or the like on an exterior surface of a first raw rubber layer 11' and paint a rubber latex 110' on the cotton yarn 12 to attach the cotton yard 12 on the exterior surface of the first raw rubber layer 11' to form a thin reinforced rubber layer 111' laminated with the cotton yarn 12, as shown in FIG. 3(A).

(b) Prepare a second raw rubber layer 210' which is shaped and sized to form at least a pair of control members 21', as shown in FIG. 3(B).

(c) Shape the first raw rubber layer 110' that is coated with the cotton yarn laminated rubber layer 111' to form at least a pair of anti-slip members 13', as shown in FIGS. 3(A) and 3(C).

(d) Align the pair of anti-slip members 13' with the pair of control members 21' in an end to end manner in two halves of heat mold M respectively.

Figure 2:
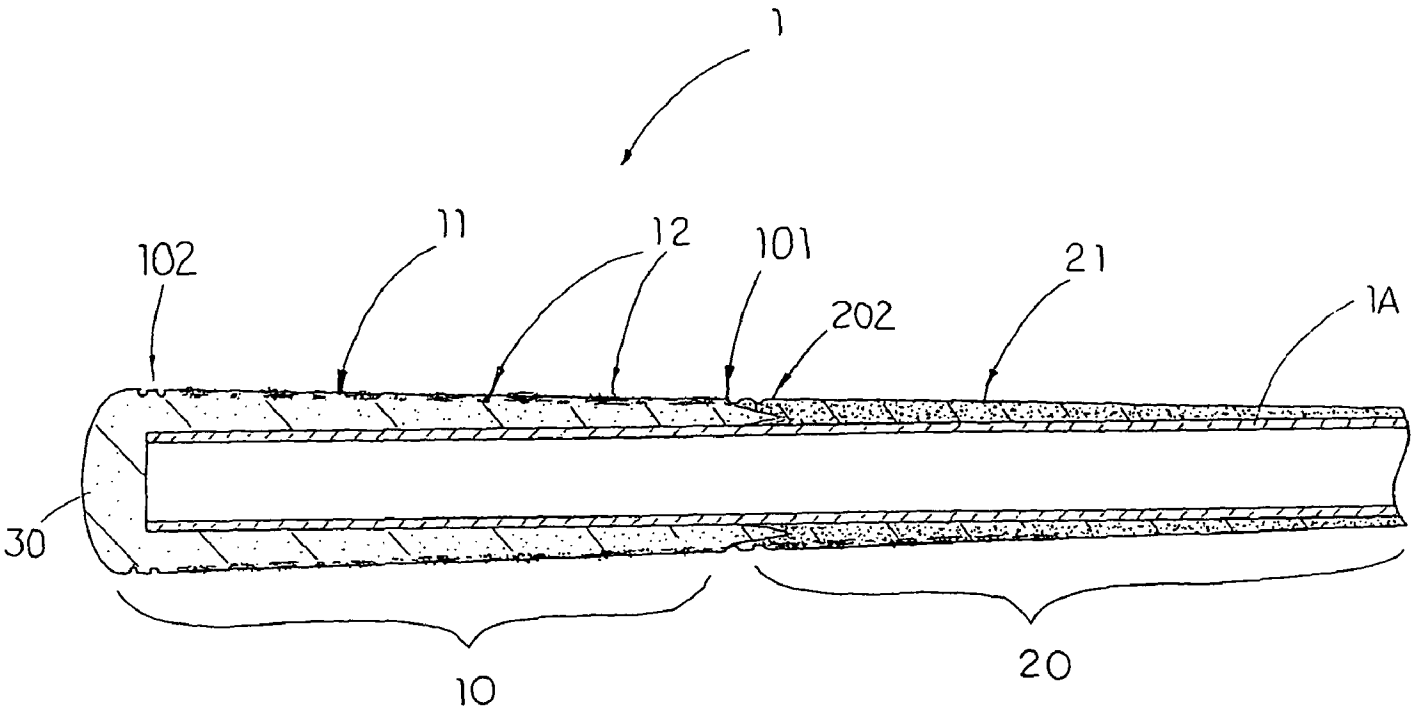
FIG. 2 is a cross-sectional view of the golf club grip with the golf club according to the above preferred embodiment of the present invention.

(e) Vulcanize the pair of anti-slip members 13' and the pair of control members 21' in the heat mold to form the golf club grip 1 including the tubular anti-slip arrangement 10 and the control arrangement 20 coaxially extended from the lower end of the anti-slip arrangement of the first member 10, wherein the raw rubber of the pair of anti-slip members 13' is vulcanized and integrated to form the tubular anti-slip arrangement of the first member 10 while the cotton yarn reinforced rubber layers 111' are also vulcanized to integrally coat on an outer circumferential surface 11 of the anti-slip arrangement of the first member 10, wherein the raw rubber of the pair of control members 21' is vulcanized with and extended from the lower end 101 of the anti-slip arrangement of the first member 10 to form the tubular control arrangement of the second member 20 which is integrated coaxially with the anti-slip arrangement of the first member 10, as shown in FIGS. 1 and 2.

In other words, only the first member 10 contains the textile fabric to provide a gripping friction on the anti-slipping surface 11 of the first member for the holding hand H which generally wears a golf glove to grip thereon. There is no textile fabric provided on the gripping surface 21 of the second member 20 to enhance the sense of touching feel for a controlling hand H' of a golfer to grip thereon.

In which, the first and second raw rubber layers 11' and 210' may have different compositions so that, after the vulcanization process, the anti-slip members 13' can be harder than the control members 21'. Various additives may be added into the first and second raw rubber layers 11', 21' to control their hardness and softness. For example, sulfur can be used to harden the raw rubber and keep it remaining flexible in the room temperature. Preferably, the lower control arrangement of the second member 20 is softer than the upper anti-slip arrangement of the first member 10. It is worth to mention that a predetermined material (1904 hardening agent) is added to the first member 10 to increase the hardness thereof for preventing any torque occurring at the first member 10. During the golfer swings the golf club, the golfer will apply the torque at the upper portion of the shaft of the golf club to twist at the first member 10. Since the upper portion of the shaft of the golf club is received in the first member 10, the angle of the club face will be unintentionally changed once the torque occurs at the first member 10.

In the step (a), the cotton yarn 12 which is overlapped on the exterior surface of the first raw rubber layer 11' is adhered on the exterior surface of the first raw rubber layer 11' by the rubber latex 110' such that, during the vulcanization step (e), the rubber latex 110' of the thin reinforced rubber layer 111' is vulcanized to integrate with the first raw rubber layer 11' to form the anti-slip arrangement of the first member 10. The amount of the rubber latex 110' to be painted on the exterior surface of the first raw rubber layer 11' is to form a thin layer of rubber latex 110' having a thickness slightly smaller than a diameter of each cotton filament of the cotton yarn 12. In other words, the cotton yarn 12 would not be completely covered by the rubber latex 110' and at least a portion of the cotton yarn 12 should be evenly and spacedly exposed outside around the anti-slip arrangement of the first member 10 after vulcanization so as to produce a coarse exterior surface as the anti-slipping surface 11 so that the holding hand H of the golfer can be substantially in contact with such exposed portions of the cotton yarn 12. Accordingly, the anti-slipping surface 11 not only provides a frictional contact with the golfer's holding hand H but also limits and controls the elasticity of the rubber material to produce a reinforced harder surface for better holding feel of the holding hand H of the golfer. In other words, the cotton yarn 12 is only formed on the first member 10 to provide different properties with respect to the second member 20.

In order to provide a better gripping effect, most of the golf club grips 1 are made in taper shape, i.e. to gradually increase its outer diameter from a lower end to an upper end. Especially, the taper angle of the upper end 102 of the anti-slip arrangement of the first member 10 generally increases for a better holding effect so that the thickness of the upper end 102 is much thicker than that of the lower end 101, as shown in FIG. 2. In addition, in order to ensure an even and smooth integration of the raw rubber materials of the lower ends of the anti-slip members 13' and the upper ends of the control members 21' to form the elongated integral tubular body of the golf club grip 1.

Each of the anti-slip members 13' has two or more longitudinal sections having different weight of raw rubber to form a tapered tubular body and to ensure the junction between the first member 10 and the second member being evenly integrated to provide an even thickness there. In order to doing so, as shown in FIG. 3(D), a taper shaped additional raw rubber piece 130' is attached to an interior surface of each of the anti-slip members 13' so as to gradually increase the weight of total raw rubber from the lower end to the upper end.

Both the anti-slip members 13' and the control members 21' should be weighted to ensure quality. Preferably, the weight of each of the anti-slip members 13' is approximately 18.8 g and the weight of each of the control members 21' is approximately 11.8 g.

As shown in FIGS. 3(B) and 3(C), both the anti-slip members 13' and the control members 21' are each cut into a predetermined taper shape adapted to form a semi-tubular shape member corresponding to the designated size and shape of the upper portion and lower portion of golf club grip 1.

As shown in FIGS. 3(F) and 3(G), the anti-slip members 13' and the control members 21' are aligned in an end-to-end manner in a semi-circular mold socket M11 or M12 of one of the base mold M1 and the upper mold M2 of a steel made vulcanization mold M. The semi-circular mold sockets M11 and M12 are aligned to form a plurality of tubular mold sockets after the base mold M1 and the upper mold M2 are connected together, wherein a plurality of core shafts S are coaxially placed inside the tubular mold sockets respectively to ensure the tubular shape of the golf club grip 1 after vulcanization. During the vulcanization, the temperature within the vulcanization mold M should be heated to 100 degree Celsius or more.

It is worth to mention that the endpiece 30 is placed at the base mold M1 at the upper end 102 of the second member to integrally attach at the upper end 102 of the second member. In addition, the color of the endpiece 30 can be the same of the color of the second member to provide a uniform appearance or can be different from the second member to enhance the aesthetic appearance of the golf club grip. Alternatively, the endpiece 30 can be attached to the upper end 102 of the second member after the first member is integrally coupled with the second member in the step (e).

According to the preferred embodiment, as shown in FIG. 3(E), before the step (e), the method may further comprise a pre-shaping step in an aluminum mold M', wherein a half of the anti-slip member 13' and a half of the control member 21' are aligned end to end in a semi-circular mold socket M1' of the aluminum mold M' to form a semi-tubular body before the vulcanization.

According to the golf club grip 1 of the present invention, as shown in FIG. 4, the upper anti-slip arrangement of the first member 10 is integrated coaxially with the lower control arrangement of the second member 20, wherein the anti-slip arrangement of the first member 10 provides a frictional surface to enable the three holding fingers H1, H2, H3 (i.e. the middle, ring and little fingers) of a gloved holding hand H of the golfer to better holding the golf club 1A with appropriate pressure and the control arrangement of the second member 20 provides a smoother surface to ensure better feeling and control for the bared controlling hand H' of the golfer.

The anti-slip arrangement of the first member 10 further comprises a cotton yarn reinforced coarse surface as the anti-slip surface 11 for better frictional contact with the gloved holding hand H of the golfer and a harder surface structure than the control arrangement of the second member 20 to ensure an anti-slipping grip with appropriate pressure while the control arrangement of the second member 20 still provide a softer and smoother feel for controlling grip of the bared controlling hand H' of the golfer.

As mentioned above, as shown in FIGS. 1 and 4, the anti-slip arrangement of the first member 10 of the golf club grip 1 has a length L1 long enough for the three holding fingers H1, H2, H3 (the middle, ring and little fingers) and the index finger H4 of the upper holding hand H of the golfer to completely grip thereon normally while the index finger H4 is just placed at the lower end 101 of the anti-slip arrangement 10, so that the ring, middle and index fingers H2', H3' and H4' of the controlling hand H' can naturally place on the control arrangement of the second member 20 of the golf club grip 1 and align immediately with the index finger H4 of the holding hand H. Also, the control arrangement of the second member 20 should generally have a length L2 longer than a size of the controlling hand H' for a completely and comfortably grip thereon.

According to the preferred embodiment of the present invention, as shown in FIGS. 1 and 4, for some golfers who may need to hold the golf club with their lower controlling hands H' with more pressure, an upper portion of a bottom side of the control arrangement of the second member 20 can be made to provide with an additional anti-slip portion 22 which is sized and shaped to ensure the middle phalanges of the ring, middle and index fingers H2', H3' and H4' of the lower controlling hand H' are in contact therewith to provide a better frictional contact for those golfers. In order to made such additional anti-slip portion 22, in the step (b) of the manufacturing method of the golf club grip 1, a piece of cotton yarn 22' is attached to an upper end portion of an exterior surface of one of the pair of control members 21' by painting a rubber latex onto the piece of cotton yarn 22' like the adhering method of the cotton yarn 12' on the first raw rubber layer 11' as taught in the step (a).

Since the cotton yarn surface reinforced anti-slip arrangement of the first member 10 is integrated with the control arrangement of the second member 20 to form an integral body where the lower end 101 of the anti-slip arrangement of the first member 10 is fused with the upper end 202 of the control arrangement of the second member 20 so as to ensure a comfortable interlocking, natural or overlapping grip between the holding hand H and the controlling hand H' of the golfer.

It is worth to mention that the cotton yarn 12 of the anti-slip arrangement of the first member 10 renders a less elasticity than the control arrangement of the second member 20 and provides a reinforced harder surface while the control arrangement of the second member 20 would have a softness softer than the anti-slip arrangement of the first member 10 for enhancing a sense of touching for the controlling hand H' of the golfer. Therefore, the golfer is able to swing the golf club 1A by securely holding the anti-slip surface 11 by the gloved holding hand H while feelingly control the golf club 1A by holding the controlling hand H' on the gripping surface 01 of the control arrangement 20. The anti-slip arrangement 10 can be made harder than the control arrangement 20 in the sense that the anti-slip arrangement 10 is less deformative with respect to pressure.

Figure 6:
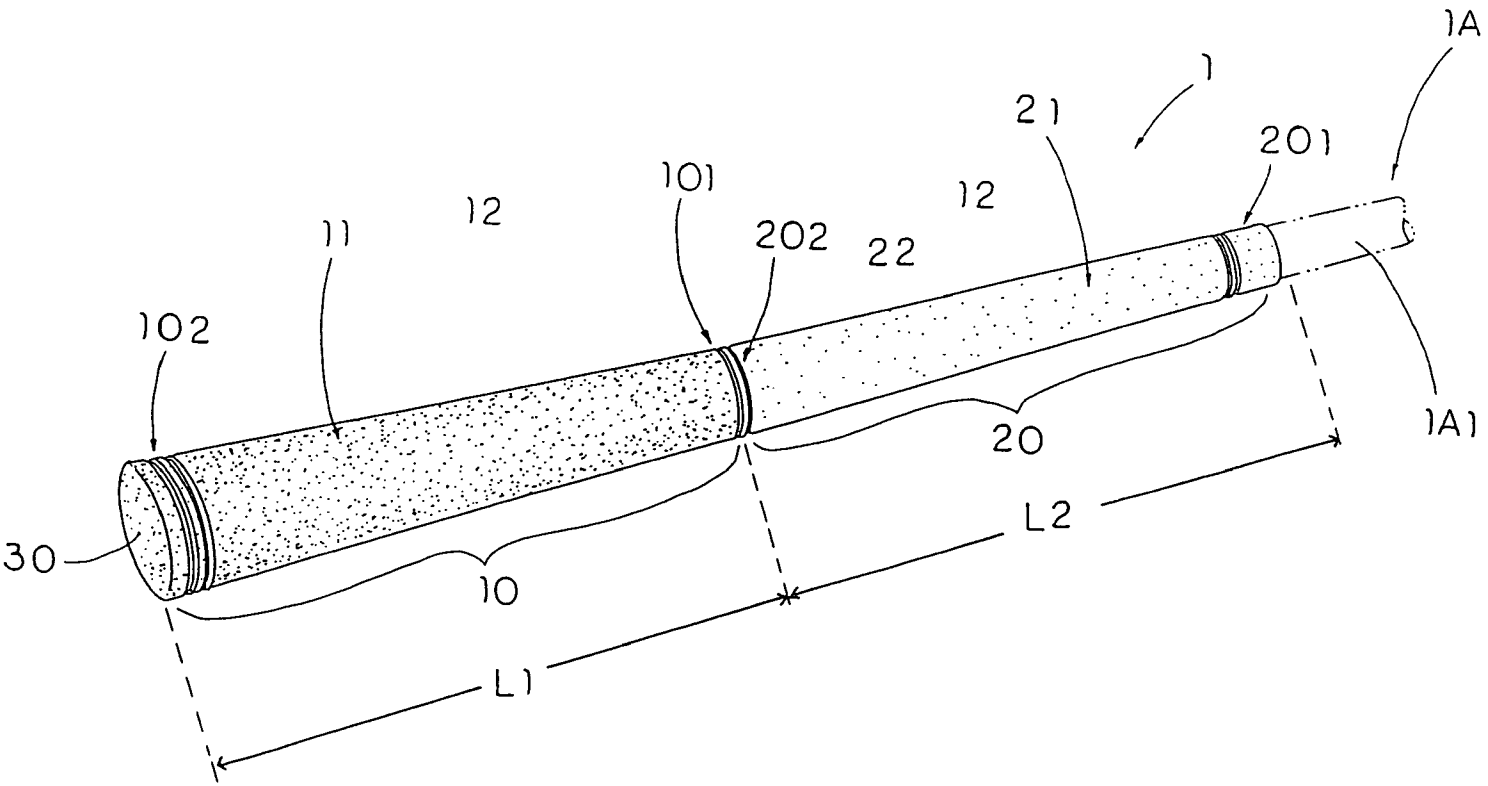
FIG. 6 is a perspective of a golf club grip according to a preferred embodiment of the present invention, illustrating the first and second members having different properties.

FIGS. 1 to 4 illustrate the first and second members 10, 20, having different properties, form the anti-slip arrangement and the control arrangement respectively and the manufacturing method thereof. FIG. 6 illustrates the first and second members 10, 20 forming in different natures to provide different properties.

Accordingly, the first and second members 10, 20 have different elasticity. One advantage of the present invention is that since the first member 10 and the second member 20 have various elasticity, a greater frictional force is created between the first member 10 and the golf glove of the holding hand H while a lesser frictional force is created between the second member 20 and the bare hand of the golfer. Since the bare hand, i.e. the controlling hand H', of the golfer directly contacts with the second member 20, the fingers of the bare hand have better sense of touching comfortably so as to enhance the control of the golf club 1A. In addition, the vibration of the golf club 1A during the swing could be absorbed by the second member 20 so as to further enhance the swinging control of the golf club 1A. Therefore, the golfer would feel comfortable when his or her controlling hand H' holds the first member 20 and his or her holding hand H holds the first member 10. This arrangement reduces the risk of the bare hand getting hurt and also helps the gloved hand to apply swinging force to golf club 1 directly.

Alternatively, the viscosity of each of the first and second members 10, 20 is selectively adjusted by adding a predetermined additive into the raw rubber of the first and second members such that the first and second members 10, 20 have different viscosities to provide different stickiness of the controlling hand H' and the holding hand H of the golfer. Accordingly, the viscosity of the first member 10 is different the viscosity of the second member 20 such that the golfer is able to hold the golf club grip in position. In other words, the viscosity of each of the first and second members 10, 20 provides a predetermined stickiness between the hands of the golfer and the outer circumferential surface of the golf club grip 1. Accordingly, the first member 10 is much sticky than the second member 20 such that the holding hand H of the golfer has a better feeling at the first member 10. Likewise, the first member 10 is less sticky than the second member 20 to fit the need of the golfer.

The manufacturing method of the golf club grip 1 to provide different viscosities at the first and second members 10, 20 is the same as the above mentioned method as shown in FIG. 3, except the anti-slip members 13' becoming the first viscosity member and the control member 21' becoming the second viscosity member. In other words, the viscosity of the first raw rubber layer 110' is different from the viscosity of the second raw rubber layer 210'. Accordingly, an additive can be added to one of the first and second raw rubber layers 110' 210' to alter the viscosity thereof when the first and second raw rubber layers 110' 210' are made of same material, so as to provide two different viscosities of the first and second members 10, 20.

Also, as described above, a color of the second member 20 is different from a color of the first member 10 to form a two-tone color club grip. The first and second members 10, 20 are made of rubbers of different colors and hardness for purposes of identification and various elasticity. Accordingly, the rubbers of different elasticity are dyed of different colors. Thus, the first member 10 and the second member 20 would appear in different colors so as to help the golfer to identify the two portions. As a result, the golfer can easily place her hands onto the correct portions. Moreover, the different colors serve the aesthetic purposes and make the club more attracting. In addition to the various colors, the portions may be variously patterned and decorated with paints for the purposes of increasing the frictional contact and decoration. For example, stripes of colors are provided at the ends and interface of the first member 10 and the second member 20, respectively. The stripes can be any colors different from those of the first and second members 10, 20 in order for indication of the same.

Figure 7:
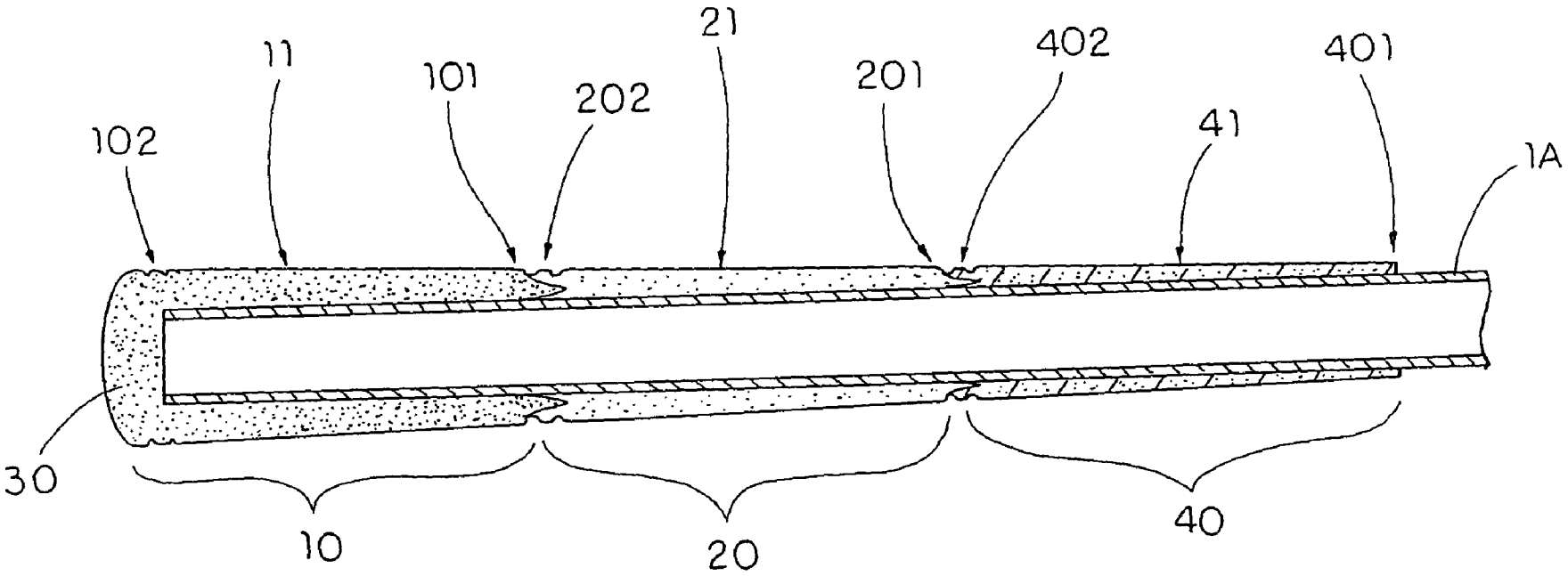
FIG. 7 illustrates the golf club grip with first, second, and third members having different natures of fabric textile, color, hardness and viscosity.

It is worth to mention that the golfer is able to tailor make the golf club grip depending on the personal preference or need by selecting the fabric textile, color, hardness and/or viscosity of each of the first and second members 10, 20 of the golf club grip. In addition, a third member and a fourth member can be integrally and coaxially extended from the first and second members to form the elongated integral tubular body of the golf club grip 1 of the present invention as shown in FIG. 7. In other words, the golf grip 1 can contain more than two tubular portions having different natures to provide different fabric textile, color, hardness and/or viscosity for the golfer to handle the golf club. For example, a third member 40 has a lower end 401 and an upper end 402, wherein the upper end 402 of the third member 40 is coaxially integrated with the lower end 201 of the second member 20, wherein an outer circumferential surface 41 of the third member 40 is integrally extended from the gripping surface 21 of the second member 20. Therefore, the second member 20 is integrally extended between the first and third members 10, 40 end-to-end to form an elongated integral tubular body for attaching to the upper end portion of the shaft 1A of the golf club. The first, second, and third members 10, 20, 40 would have different fabric textiles, colors, hardness and/or viscosities. In other words, the first member 10 may have a combination of fabric textile, color, hardness, and viscosity different from the second and third members 20, 40.

Figure 8:
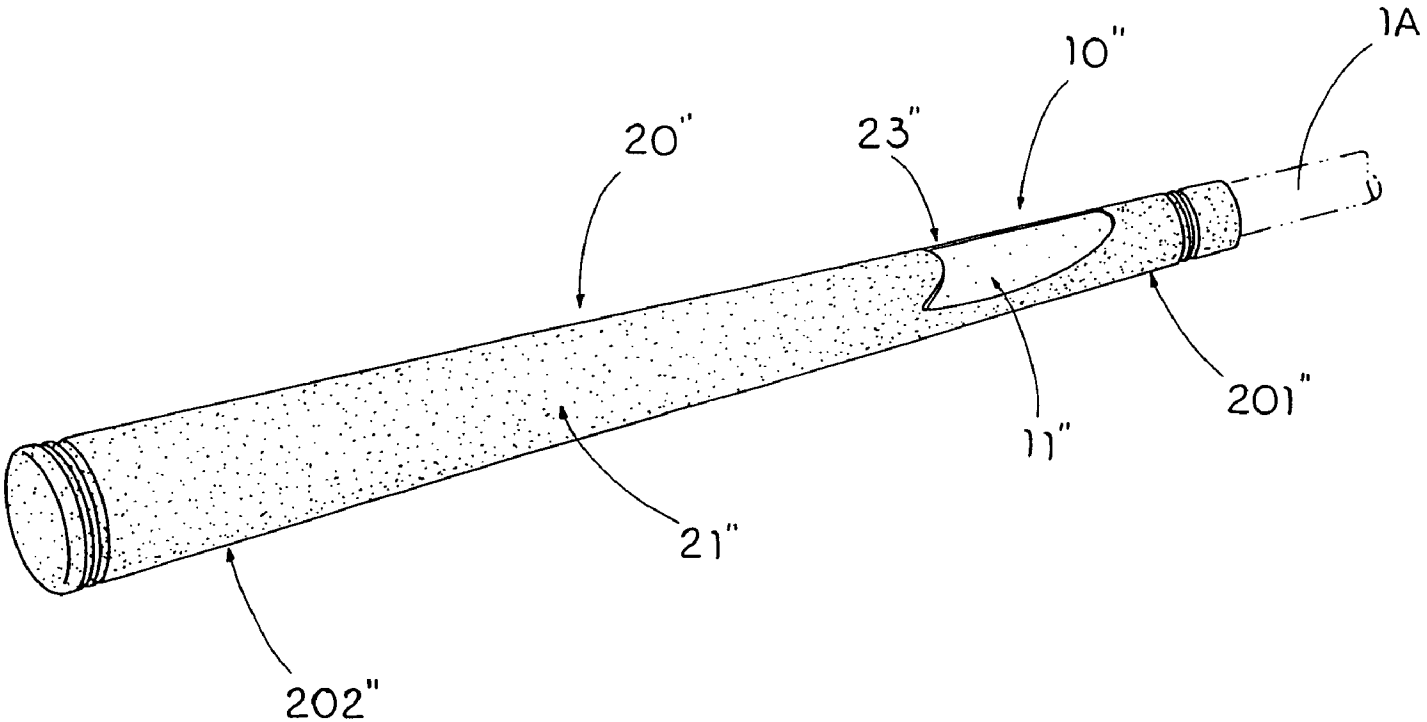
FIG. 8 is a perspective view of a golf club grip according to a second preferred embodiment of the present invention.
Figure 9:
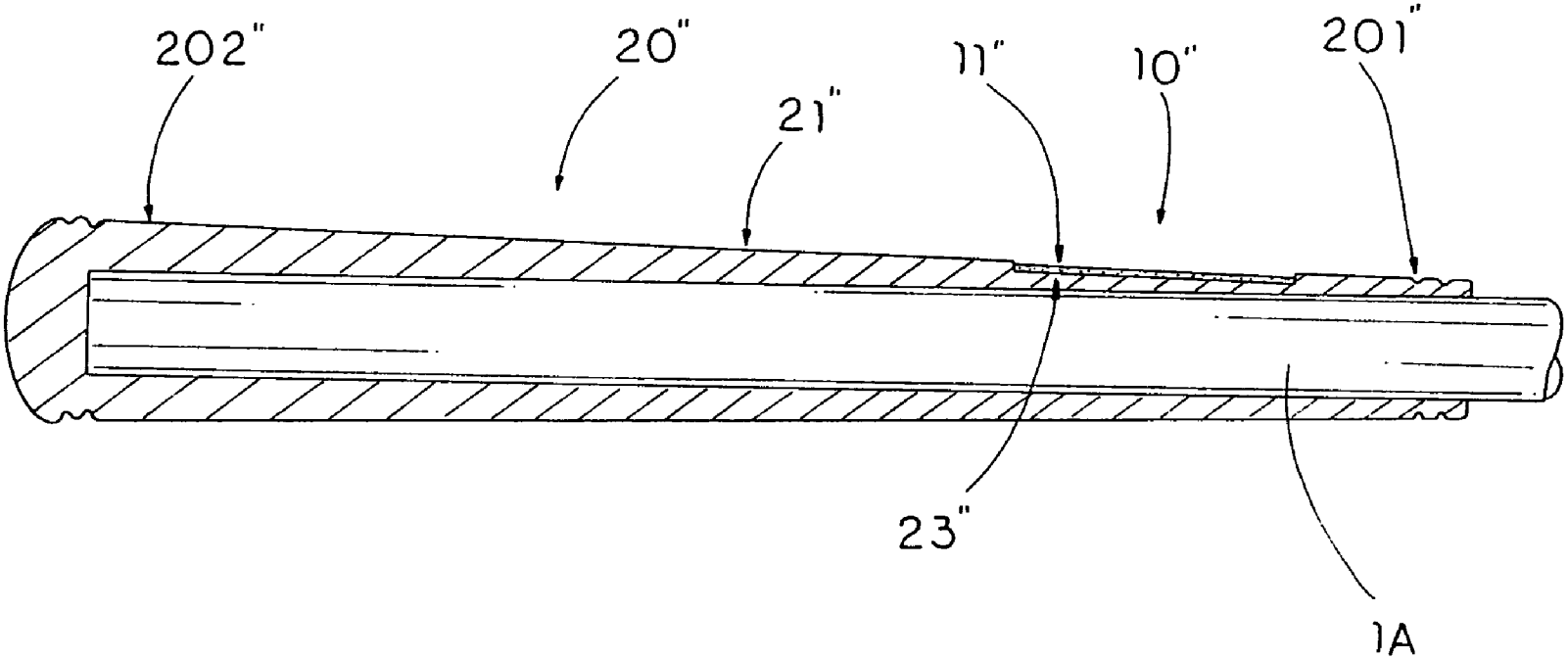
FIG. 9 is a sectional side view of the golf club grip according to the above second preferred embodiment of the present invention.

Referring to FIG. 8 to FIG. 9 of the drawings, a golf club grip according to a second preferred embodiment of the present invention is illustrated, in which the gold club grip comprises at least one second member 20", and at least one first member 10". The golf club grip of the present invention is for a golf club including a shaft 1A and a club head attached to a lower end of the shaft 1A.

The second member 20", which is rubber made tube, has a lower end 201", an upper end 202" and a gripping surface 21" defining between the upper end 202" and the lower end 201".

The first member 10" which is rubber-made having an outer peripheral surface 11" integrated with the second member 20" to form an elongated integral tubular body for attaching to an upper end portion of the shaft 1A of the golf club, wherein the first and second members 10", 20" have different natures to provide a corresponding number of different physical properties of the golf club grip.

According to the second preferred embodiment of the present invention, the second member 20" further has at least one through logo slot 23" formed along the gripping surface 21", wherein the logo slot 23" has a predetermined size and shape resembling with a predetermined logo which is to be displayed on the golf club grip. Accordingly, the first member 10" is shaped and sized to corresponding with the shape and size of the logo slot 23" formed on the second member 20" so that the outer peripheral surface 11" of the first member 10" is adapted to integrate with a surrounding sidewall of the logo slot 23" so as to integrate the second member 20" with the first member 10" in a seamless manner for forming the golf club grip of the present invention.

It is worth mentioning that the first member 10" and the second member 20" preferably display two different physical and visual properties respectively, such as two different colors, for distinctly visualizing the predetermined logo displayed on the golf club grip. The logo can be the trademark of a particular brand, or any preferred aesthetic pattern. In order to integrate the first member 10" with the second member 20", both are put into a heat treatment machine for vulcanization so as to integrate the peripheral surface 11" of the first member 10" with the surrounding side wall of the logo slot 23" of the second member 20".

Figure 10:
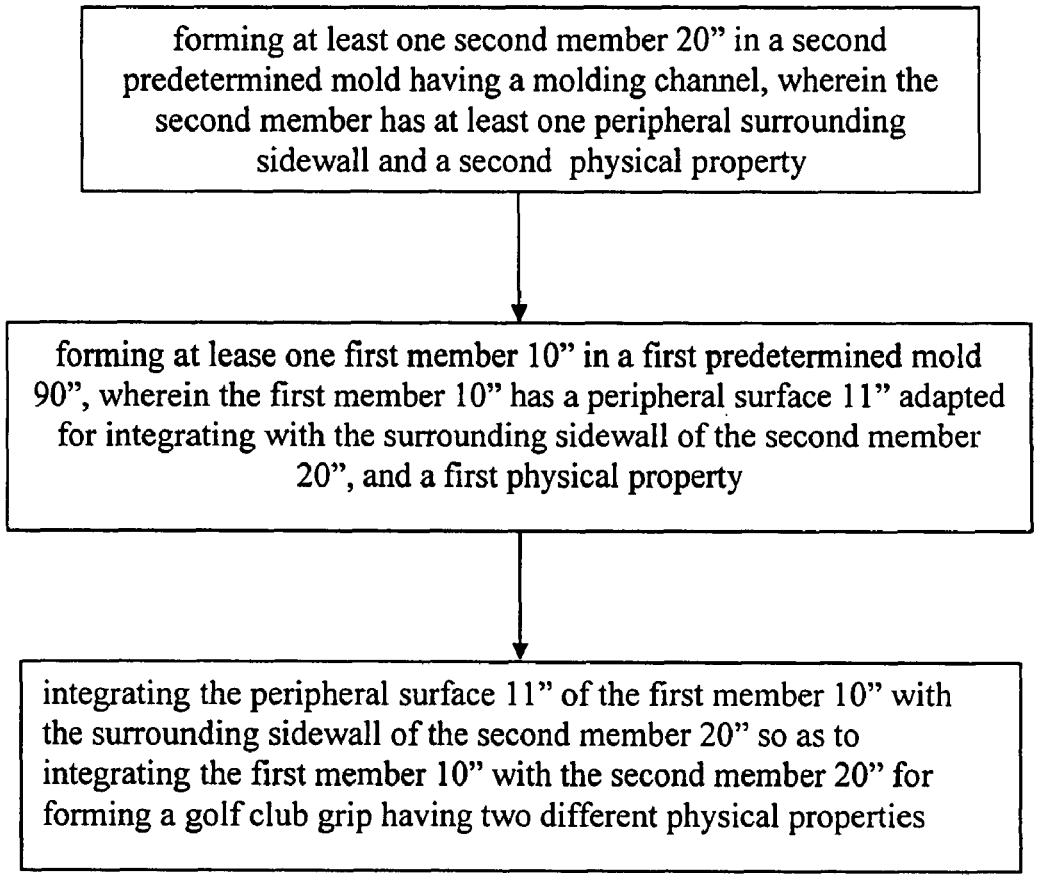
FIG. 10 is a method of manufacturing a golf club grip according to the above second preferred embodiment of the present invention.

Referring to FIG. 10 of the drawings, a method of manufacturing a golf club grip according to the second preferred embodiment of the present invention is illustrated, in which the method comprises the steps of:

(a") forming at least one second member 20" in a second predetermined mold having a molding channel, wherein the second member has at least one peripheral surrounding sidewall and a second physical property;

(b") forming at lease one first member 10" in a first predetermined mold 90", wherein the first member 10" has a peripheral surface 11" adapted for integrating with the surrounding sidewall of the second member 20", and a first physical property; and (c") integrating the peripheral surface 11" of the first member 10" with the surrounding sidewall of the second member 20" so as to integrating the first member 10" with the second member 20" for forming a golf club grip having two different physical properties.

According to the preferred embodiment of the present invention, in step (a"), the second mold further has at least one protrusion integrally protruded from the a bottom surface of the molding channel, wherein the protrusion has a predetermined size and shape corresponding to a logo slot 23" of the second member 20", so that when the second member 20" is formed in the molding channel, the protrusion forms the logo slot 23" on the second member 20", wherein the logo slot 23" has a surrounding sidewall for integrating with the first member 10".

Thus, step (a") comprises a step (a.1") of molding the second member 10" in the second predetermined mold having a molding channel and at least one protrusion integrally protruded from the molding channel, in such a manner that the protrusion forms a logo slot 23" of the second member 20".

In step (b"), the first member 10" is shaped and sized to correspond with the shape and size of the logo slot 23" of the second member 20" so that the first member 10" is adapted to be disposed within the logo slot 23". As mentioned above, the first member 10" has a peripheral surface 11" for integrating with the surrounding sidewall of the logo slot 23" of the second member 20".

Step (c") comprises the steps of:

(c.1") placing the first member 10" into the logo slot 23" of the second member 20", wherein the surrounding sidewall of the logo slot 23" is fittedly aligned with the peripheral surface 11" of the first member 10"; and (c.2") vulcanizing the first member 10" and the second member 20" for integrating the surrounding sidewall of the logo slot 23" with the peripheral surface 11" of the first member 10" to form the golf club grip having two physical properties.

It is worth mentioning that according to the second preferred embodiment of the present invention, a thickness of the first member 10" is slightly lower than a height of the logo slot 23" of the second member 20" so as to create a slight indention of the golf club grip. This slight indention may serve a number of purposes depending circumstances in which the present invention is utilized. For example, this slight indention may create a special aesthetic effect of the golf club grip. Alternatively, this slight indention may serve as a guide of the position of the user's hands by indicating a preferred position at which particular user's finger should be placed. Commercially, the slight indention may serve as emphasizing a trademark of a particular brand of the golf club grip.

It is important to point out that there may be more first members 10" for forming more aesthetic or brand patterns. Accordingly, the second member 20" may have more logo slots 23" for accommodating the increased first members 10". For example, if one wishes to incorporate the word "GOLF" onto the second member 20", it must have four logo slots 23" having shapes corresponding to the word "GOLF" respectively. Then, there are four first members 10" having the corresponding shapes of the four logo slots 23" respectively.

Figure 11:
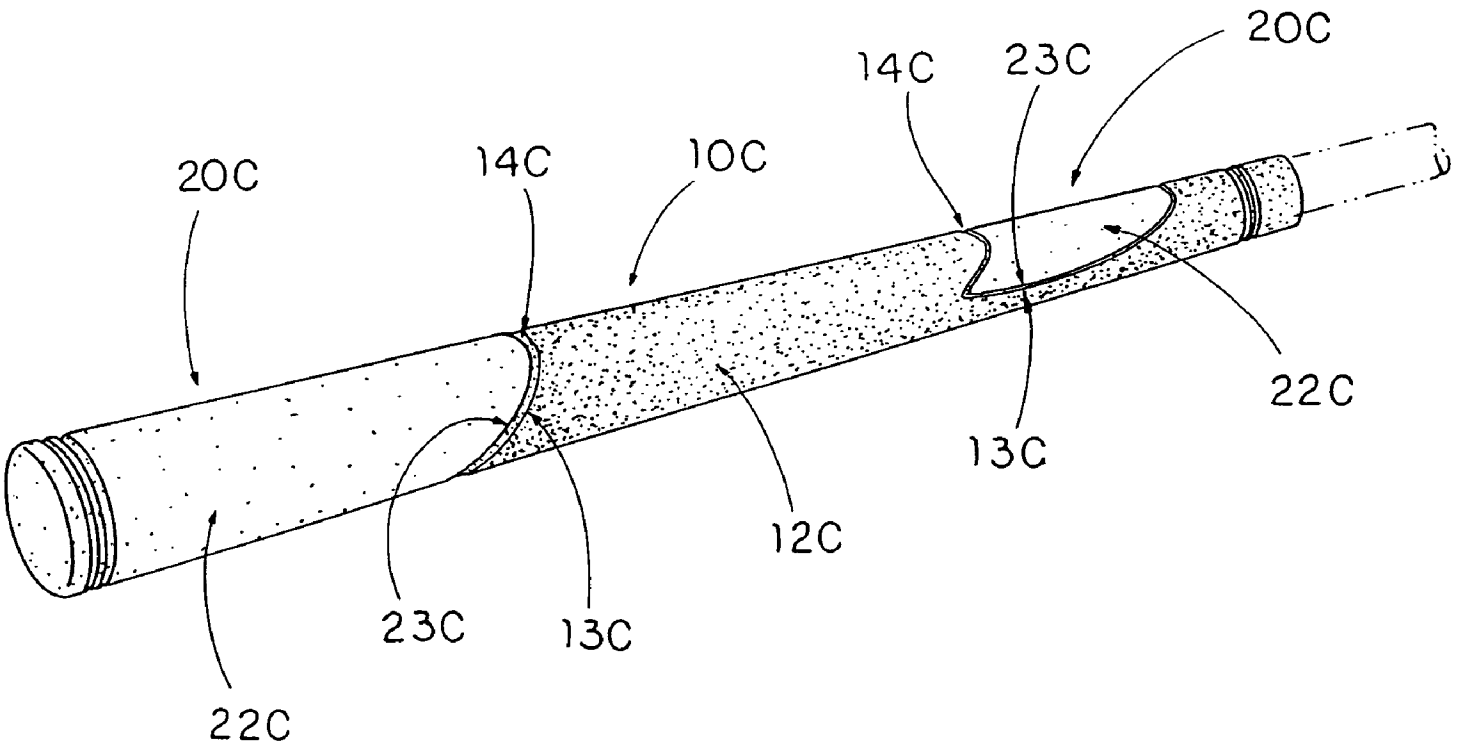
FIG. 11 is a perspective view of a golf club grip according to a third preferred embodiment of the present invention.
Figure 12:
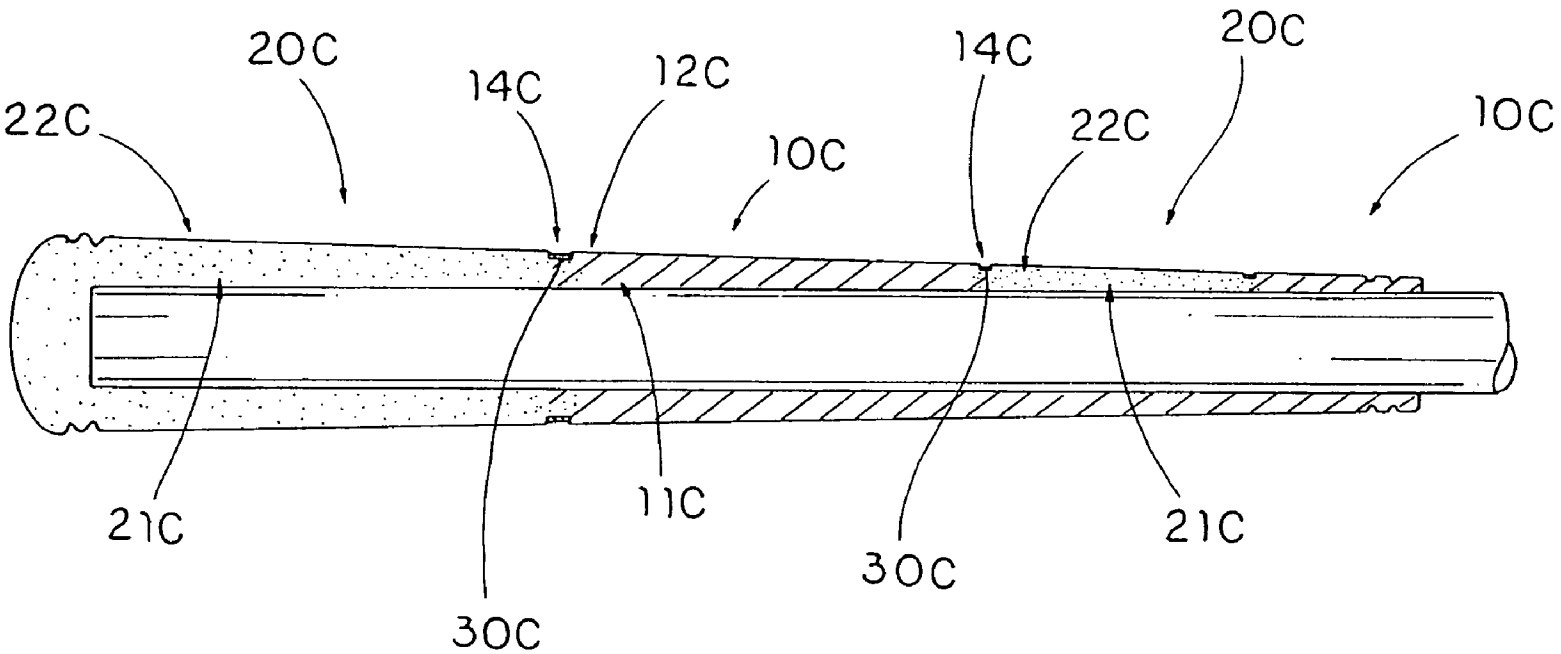
FIG. 12 is a schematic diagram of a method of manufacturing a golf club grip according to the above third preferred embodiment of the present invention.

Referring to FIG. 11 to FIG. 12 of the drawings, a golf club grip according to a third preferred embodiment of the present invention is illustrated, in which the golf club grip comprises a first grip member 10C, and a second grip member 20C. The golf club grip of the present invention is for mounting onto a golf club comprising a shaft and a club head attached to a lower end of the shaft.

The first grip member 10C has a dark color and a first material density, and defines a first inner layer 11C, a first outer layer 12C, and a first attachment edge 13C.

On the other hand, the second grip member 20C has a light color and a second material density which is greater than the first material density, and defines a second inner layer 21C, a second outer layer 22C, and a second attachment edge 23C, wherein the first attachment edge 13C is integrated with the second attachment edge 23C in an edge-to-edge manner to form an elongated tubular structure of the light and the dark colors for fittedly embedding the shaft of the golf club, wherein when the first grip member 10C and the second grip member 20C are heated to integrate with each other at the first attachment edge 13C and the second attachment edge 23C, particles of the second grip member 20C at the second inner layer 21C crosses over the first grip member 10C at the first inner layer 11C to form a predetermined amount of light color at the first grip member 10C, while the light color formed at the first inner layer 11C of the first grip member 10C is adapted to be overlaid by the same dark color so as to render the light and the dark color sharply distinguishable at an intersection between the first attachment edge 13C and the second attachment edge 23C on an outer surface of the gold club grip.

According to the third preferred embodiment of the present invention, the first grip member 10C is made of rubber materials having a darker color (e.g. black color) as compared with the lighter color (e.g. red color) of the second grip member 20C, wherein when the first grip member 10C is heated up at a predetermined temperature, the first grip member 10C will melt for integrating with other materials, such as the second grip member 20C. Moreover, the first grip member 10C is preferably embodied as having a tubular structure having a diameter substantially the same as the diameter of the shaft so that the first grip member 10C is capable of mounting onto the shaft as a grip for a user of the golf club.

Similarly, the second grip member 20C is also made of rubber materials such that when the second grip member 20C is heat up to a predetermined temperature, the second grip member 20C will melt for integrating with other materials, such as the first grip member 10C.

In order for the cross over between the first grip member 10C and the second grip member 20C to take place, the first and the second materials density must be such that when the first and the second grip member 10C, 20C are heated-treated to integrate with each other at the intersection between the first attachment edge 13C and the second attachment edge 23C, particles of the second grip member 20C will, by their heavier materials density, migrate to the first grip member 10C, and when the particles of the second grip member 20C have migrated to the first grip member 10C, the originally dark color of the first grip member 10C will be lightened by the presence of the particles of the second grip member 20C. This is the reason why the darker first grip member 10C will need overlaying by the same dark color. However, it must be averred that since the lighter color formed on the first grip member 10C can easily be overlaid by the same original darker color of the first grip member 10C, the finishing product of the golf club grip of the present invention would have two colors sharply distinguishable from each other.

According to the third preferred embodiment of the present invention, the ratio of the material density of the first grip member 10C to the material density of the second grip member 20C is 2:3. For example, when the overall weight of the golf club grip is 50*g*, the weight of the first grip member 10C and the second grip member 20C would be 20*g* and 30*g* respectively. The ratio ensures that cross over of particles occur when the first and the second grip member 10C, 20C are subject to heat treatment.

Accordingly, the golf club grip of the present invention further comprises a touch-up layer 30C having the same color as the first grip member 10C overlaid on the outer layer 12C of the first grip member 10C for covering the light-colored particles which are migrated from the second grip member 20C when the first and the second grip member 10C, 20C are subject to heat treatment. It is worth mentioning that the touch-up layer 30C can be applied to the outer layer 12C of the first grip member 10C by conventional coloring techniques, such as conventional coating or painting.

Moreover, in order to avoid unwanted migration of particles from the second grip member 20C to the first grip member 10C at the first outer layer 12C when the heat treatment is carried out, a blocking rib 41C is formed on the mold for forming the golf club grip of the present invention. Correspondingly, the golf club grip further has an indention groove 14C indently formed on the first grip member 10C at a position adjacent to the first attachment edge 13C, wherein the indention groove 14C is formed by the pressing of the blocking rib 41 at the heat treatment stage for blocking unwanted migration from the second grip member 20C.

It is also worth mentioning that each of the first and the second grip members 10C, 20C can be formed as a logo piece having the attachment edge (13C, 23C) formed as a peripheral edge of the logo piece so that when the first and the second grip member 10C, 20C attaches with each other under heat treatment, the result golf club grip would have a dominant first grip member 10C having a second grip member 20C as a logo formed on the first grip member 10C, or vice versa.

Figure 13:
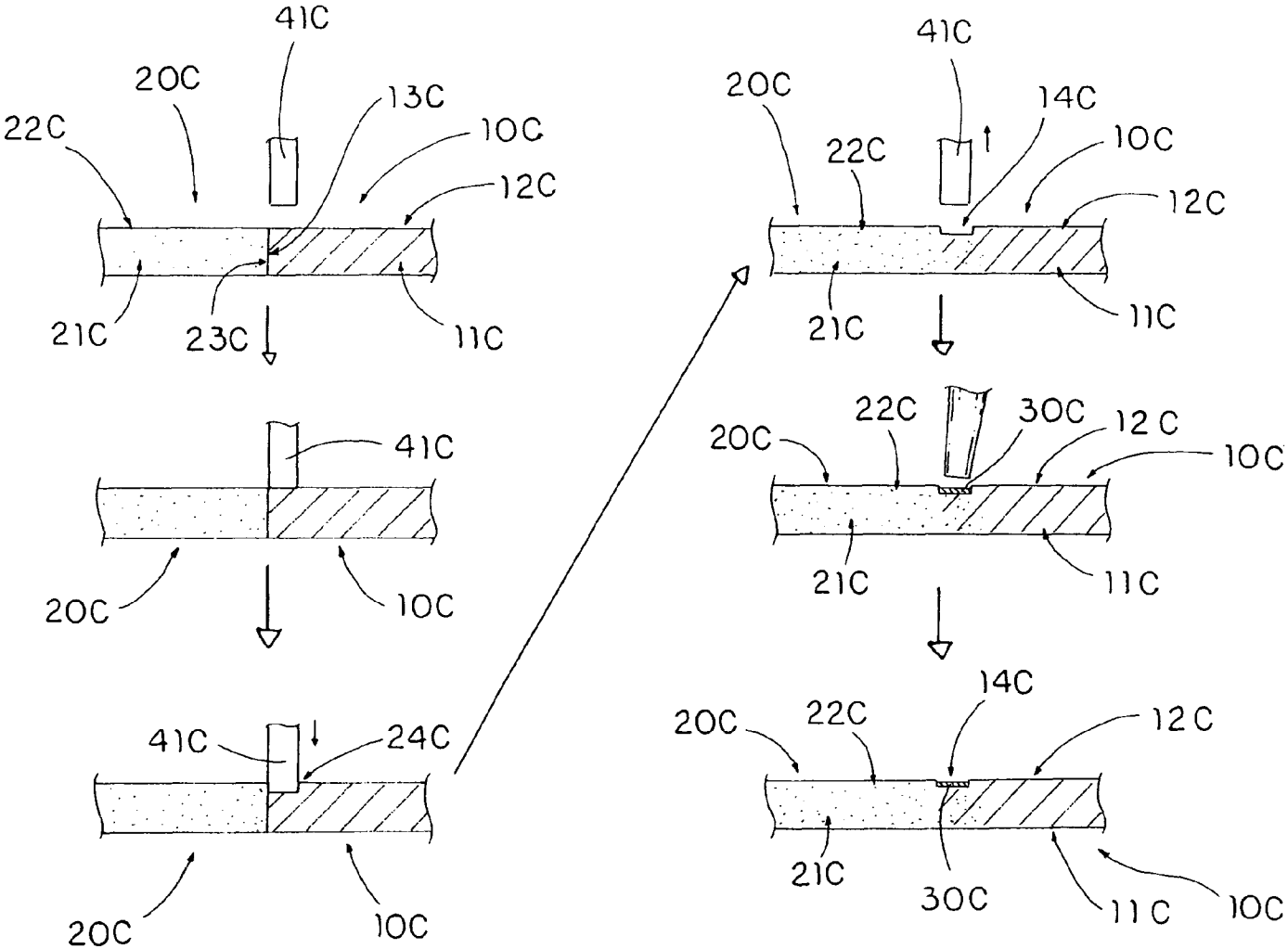
FIG. 13 is a flow diagram of a method of manufacturing a golf club grip according to the above third preferred embodiment of the present invention.

Referring to FIG. 13 of the drawings, a method of manufacturing a golf club grip according to the third preferred embodiment of the present invention is illustrated, in which the method comprises the steps of:

(a) forming at least one first grip member 10C, wherein the first grip member 10C has a dark color and a first material density, defining a first inner layer 11C, a first outer layer 12C, and a first attachment edge 13C;

(b) forming at least one second grip member 20C, wherein the second gripping member 20C has a light color and a second material density which is greater than the first material density, defining a second inner layer 21C, a second outer layer 22C, and a second attachment edge 23C;

(c) heat-integrating the first and the second grip member 10C, 20C in a third predetermined mold having a molding channel and a blocking rib 41C extended in the molding channel, wherein the blocking rib 41C is arranged to press against the second outer layer 22C of the second gripping member 20C at an intersection of the first attachment edge 13C and the second attachment edge 23C; wherein when the first grip member 10C and the second grip member 20C is heated to integrate with each other at the first attachment edge 13C and the second attachment edge 23C, particles of the second grip member 20C at the second inner layer 21C crosses over the first grip member 10C at the first inner layer 11C to form a predetermined amount of light color at the first grip member 10C, while particles of the second grip member 20C at the second outer layer 22C is blocked by the blocking rib 41C to cross over the first grip member 10C; and (d) overlaying the dark color on the intersection of the first grip member 10C and the second grip member 20C to form a touch-up layer 30C on the first outer surface 12C of the first grip member 10C, so as to render the light and the dark color sharply distinguishable at an intersection between the first attachment edge 13C and the second attachment edge 23C on an outer surface of the gold club grip.

According to the third preferred embodiment of the present invention, step (a) comprises the step of cutting a predetermined size of a first piece of rubber materials as the first grip member 10C, wherein the rubber materials have the dark color and the first material density. Similarly, step (b) comprises a step of cutting a predetermined size of a second piece of rubber materials as the second grip member 20C, wherein the rubber materials have the light color and the second material density.

Step (c) comprises the steps of:

(c.1) putting the first and the second grip member 10C, 20C into the molding channel of the third predetermined mold in such a manner that the first and the second grip member 10C, 20C are positioned in an edge-to-edge manner with the first attachment edge 13C being placed side-by-side with the second attachment edge 23C, wherein the blocking rib 41C is arranged to press against the second outer layer 22C of the second gripping member 20C at an intersection of the first attachment edge 13C and the second attachment edge 23C for preventing cross over of particles from the first grip member 10C to the second grip member 20C;

(c.2) heating the first grip member 10C and the second grip member 20C within the third predetermined mold until the first grip member 10C and the second grip member 20C slightly melt within the molding channel for integrating the first attachment edge 13C with the second attachment edge 23C, and for allowing cross over of particles from the second grip member 20C to the first grip member 10C at the second inner layer 22C and the first inner layer 12C; and (c.3) cooling down the first and the second grip member 10C, 20C in the third predetermined mold to form a semi-finished grip product in which a predetermined amount of light color is migrated to the first grip member 10C.

It is worth mentioning that when the semi grip product is cooled down, the indention groove 14C is formed on the outer layer 10C of the first grip member 10C because of the blocking rib 41C pressing against the first grip member 10C when the first and the second grip member 10C, 20C are heat-treated inside the molding channel.

Accordingly, step (d) comprises the step of touching-up the light color on the first grip member 10C for forming the touch-up layer 30C so as to render the golf club grip with the light and the dark color sharply distinguishable at the intersection between the first grip member 10C and the second grip member 20C.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A golf club grip for a golf club comprising a shaft and a club head attached to a lower end of said shaft, wherein said golf club grip comprises:

a first grip member which has a dark color and a first material density, defining a first inner layer, a first outer layer, and a first attachment edge; and a second grip member which has a light color and a second material density which is greater than said first material density, defining a second inner layer, a second outer layer, and a second attachment edge, wherein said first attachment edge is integrated with said second attachment edge in an edge-to-edge manner to form an elongated tubular structure of said light and dark colors for embedding said shaft, wherein when said first grip member and said second grip member is heated to integrate with each other at said first attachment edge and said second attachment edge, particles of said second grip member at said second inner layer crosses over said first grip member at said first inner layer to form a predetermined amount of light color at said first grip member, while said light color formed at said inner layer of said first grip member is adapted to be overlaid by said dark color so as to render said light and said dark color sharply distinguishable at an intersection between said first attachment edge and said second attachment edge on an outer surface of said gold club grip.

2. The golf club grip, as recited in claim 1, wherein a ratio of said material density of said first grip member to said material density of said second grip member is two to three.

3. The golf club grip, as recited in claim 2, further comprises a touch-up layer having the same color as said first grip member overlaid on said outer layer of said first grip member for covering said light-colored particles of said second grip member which are migrated from said second grip member when said first and said second grip member are heat up to integrate with each other.

4. The golf club grip, as recited in claim 3, further having an indention groove indently formed on said first grip member at a position adjacent to said first attachment edge.

5. The golf club grip, as recited in claim 4, wherein each of said first grip member and said second grip member has a tubular structure having a diameter substantially the same as a corresponding portion of a diameter of said shaft so that said first grip member and said second grip member are capable of fittedly attaching onto said shaft as a grip for said golf club.

6. The golf club grip, as recited in claim 4, wherein one of said first and said second grip members is formed as a logo piece having said corresponding attachment edge formed as a peripheral edge of said logo piece.

7. The golf club grip, as recited in claim 1, further comprises a touch-up layer having the same color as said first grip member overlaid on said outer layer of said first grip member for covering said light-colored particles of said second grip member which are migrated from said second grip member when said first and said second grip member are heat up to integrate with each other.

8. The golf club grip, as recited in claim 7, further having an indention groove indently formed on said first grip member at a position adjacent to said first attachment edge.

9. The golf club grip, as recited in claim 8, wherein each of said first grip member and said second grip member has a tubular structure having a diameter substantially the same as a corresponding portion of a diameter of said shaft so that said first grip member and said second grip member are capable of fittedly attaching onto said shaft as a grip for said golf club.

10. The golf club grip, as recited in claim 8, wherein one of said first and said second grip members is formed as a logo piece having said corresponding attachment edge formed as a peripheral edge of said logo piece.

11. The golf club grip, as recited in claim 1, being manufacturing by a method which comprises the steps of:

(a) forming at least one first grip member, wherein said first grip member has a dark color and a first material density, defining a first inner layer, a first outer layer, and a first attachment edge;

(b) forming at least one second grip member, wherein said second gripping member has a light color and a second material density which is greater than said first material density, defining a second inner layer, a second outer layer, and a second attachment edge;

(c) heat-integrating said first and said second grip member in a third predetermined mold having a molding channel and a blocking rib extended in said molding channel, wherein said blocking rib is arranged to press against said second outer layer of said second gripping member at an intersection of said first attachment edge and said second attachment edge; wherein when said first grip member and said second grip member is heated to integrate with each other at said first attachment edge and said second attachment edge, particles of said second grip member at said second inner layer crosses over said first grip member at said first inner layer to form a predetermined amount of light color at said first grip member, while particles of said second grip member at said second outer layer is blocked by said blocking rib to cross over said first grip member; and (d) overlaying said dark color on said intersection of said first grip member and said second grip member on said first outer surface of said first grip member, so as to render said light and said dark color sharply distinguishable at an intersection between said first attachment edge and said second attachment edge on an outer surface of said gold club grip.

* * * * *